US006320317B1

(12) United States Patent
Keller et al.

(10) Patent No.: US 6,320,317 B1
(45) Date of Patent: Nov. 20, 2001

(54) GLASS SEAL RESISTOR COMPOSITION AND RESISTOR SPARK PLUGS

(75) Inventors: Joseph Michael Keller, Grand Blanc; Richard Frederick Beckmeyer, Davisburg; William J. LaBarge, Bay City, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/451,782

(22) Filed: Dec. 1, 1999

(51) Int. Cl.[7] ..... H01J 13/46

(52) U.S. Cl. ..... 315/46; 315/71; 313/118; 313/136; 252/507; 252/510

(58) Field of Search ..... 315/71, 46, 77; 313/134, 136, 118, 119; 252/507, 510, 512, 520

(56) References Cited

U.S. PATENT DOCUMENTS

| | | | | |
|---|---|---|---|---|
| 2,864,884 | | 12/1958 | Counts et al. | 174/152 |
| 3,235,655 | | 2/1966 | Counts et al. | 174/152 |
| 3,525,894 | | 8/1970 | Blum | 313/136 |
| 3,567,658 | | 3/1971 | Webb et al. | 252/506 |
| 3,703,387 | | 11/1972 | Kesten et al. | 106/46 |
| 3,831,562 | * | 8/1974 | Paxton et al. | 123/8.09 |
| 3,973,234 | * | 8/1976 | Youtsey et al. | 338/226 |
| 4,112,330 | | 9/1978 | Stimson et al. | 315/46 |
| 4,795,944 | | 1/1989 | Stimson | 315/71 |
| 5,650,633 | * | 7/1997 | Ahmed et al. | 252/183.11 |

* cited by examiner

*Primary Examiner*—Haissa Philogene
(74) *Attorney, Agent, or Firm*—Charles K. Veenstra

(57) ABSTRACT

A resistor seal composition useful in resistor spark plugs, comprises glass, at least one metal oxide, at least one filler material, and a branched or straight chained zirconium carboxylate. The glass comprises a strontium borate glass and/or a borosilicate glass. Metal oxides include aluminum oxide, zinc oxide, and zirconium oxide. Filler materials include silicon dioxide and mullite.

12 Claims, 5 Drawing Sheets

GLASS SEAL RESISTOR COMPOSITION AND RESISTOR SPARK PLUGS

TECHNICAL FIELD

The invention relates to resistor glass seal compositions, particularly resistor composites, suitable for use in resistor spark plugs of the automotive type.

BACKGROUND OF THE INVENTION

Resistor spark plugs employ a glassy, relatively high resistance seal material between the terminal screw and the center electrode. During spark plug manufacture, such a seal composition, in particulate mixture form, is loaded into the center bore of an insulator body onto the upper end of a previously placed center electrode. A metal terminal screw is then placed in the bore of the insulator so that the lower end of the screw rests on top of the particulate mixture. The assembly is then fired in a furnace at a relatively high temperature to fuse the glass and soften the material so that the terminal screw can be pushed down into the fused composition.

The firing of the composition produces a fused glassy mass, which provides a gas-tight seal in the interior of the spark plug insulator body between the center electrode and the terminal screw. The composition contains metal particles, which, during the firing operation, fuse and provide a bond between the metal conductors and the resistive seal composition.

Spark plug resistor glass seals have proven to be effective in suppressing high frequency oscillations that occur during spark discharge in an automotive ignition system. These oscillations lead to electromagnetic interference that can effect radios, computers and other electronic automotive components. In performing this function, it is important that the original particulate mixture fuse upon firing to form a mass that has a predictably high level of resistance and that such level of resistance not change appreciably during prolonged usage of the spark plug in engine operation.

The prior art teaches two basic types of monolithic spark plug resistor glass seals, both of which are described in U.S. Pat. No. 3,567,658. One type of monolithic spark plug, disclosed in U.S. Pat. No. 2,864,884, has a resistive glass seal comprising a semi-conductor material, glass, filler material, and a small percentage of a reducing agent, such as powdered metal or carbon, to control the resistivity of the seal. Examples of semi-conductor materials in this type of monolithic spark plug are $TiO_2$, $SnO_2$, $Ta_2O_5$, $MoO_3$ and $Al_2O_3$.

A second type of monolithic spark plug, such as disclosed in U.S. Pat. No. 2,459,282, has a resistor glass seal comprising a heterogeneous mixture of conductive materials, such as carbon, metals, metal oxides, and metal carbides, dispersed within a continuous glass phase. In such spark plugs, the resistance of the plug is dependent on the concentration of the conductive phase while the glass forms a dense, hermetic seal. Due to the heterogeneous nature of the conductive phase and the multiple conductive materials therein, part-to-part variation is often difficult to minimize. Historically, carbon based materials have been added to the mixture in forms which range in size, density and degree of water solubility. Such differences in the raw materials lead to variation in the continuity of the carbon phase and difficulty in reproducing the overall spark plug resistance. Processing of the raw materials so as to maintain microstructural uniformity becomes a significant challenge.

Most notably, the prior art makes use of a conductive phase consisting of a water soluble form of carbon (e.g. 10-X sucrose) and a solid particulate form of carbon (e.g. thermax or graphite). These two materials must be added carefully to control the resistivity of the final composite material. Because both materials yield a conductive form of carbon after significant heat treatment, the corresponding resistance of the spark plug decreases as the concentration of the carbon sources increases. Also, the ratio of the 10-X sucrose to the thermax is important. When acting alone, the 10-X sucrose causes an increase in resistance due to electrical aging of the glass seal. Conversely, the thermax, when acting alone, will cause a decrease in the resistance of the spark plug due to electrical aging. A ratio of the two materials can be determined which yields minimal electrical aging during the lifetime of the plug. Thus, a proper concentration and ratio of each carbon source is necessary for a satisfactory glass seal.

Another important consideration is the distribution of the two carbon sources within the glass seal. Typically, the particulate carbon is poorly distributed in the glass seal body and can be detected as clusters rich in carbon. Compositional homogeneity of the resistor seal is necessary for a seal with very tight resistance tolerance. Homogeneous mixing of the thermax is difficult due to its low concentration in the mixture (less that 3% by weight) and its relatively hydrophobic nature. Thus, high energy agitation is necessary to ensure sufficient mixing.

Another difficulty arises with the migration of the 10-X sucrose within the mixture, as water is evaporated during drying. As water migrates to the surface of the particles where it evaporates, the 10-X sucrose can migrate as well, resulting in uneven distribution and an undesirable conductive coating on the outside of the agglomerates. Both phenomena lead to non-uniformity in the composition and variability in the resistivity of the material.

Another shortcoming of the prior art relates to spark plug failure attributable to a breakdown of the bonding between resistor glass seals and spark plug electrodes. Due to extreme electrical and thermal stress in the spark plug during operation, the interface of the seals and electrodes is often disrupted, leading to operation failure. To account for this, spark plugs with conductive glass seals, in addition to the resistor glass seal, are currently in use. The conductive glass seals typically consist of metal particles, commonly copper or nickel, dispersed within a glass phase. The conductive seals provide for a low electrical resistance path from the center electrode or the terminal post surface to the resistor glass seal interface. The conductive seals are typically positioned on each end of the resistor seal to directly interface with the electrodes. The primary disadvantage of adding conductor seals is the resulting reduction in length of the resistor seal. The conductor seal is placed into the plug at the expense of the resistor, shortening the ends of the resistor seal. This change in the length of the resistor seal decreases its ability to suppress radio frequency interference (RFI), its primary function.

Efforts have been made to improve bonding of the resistor glass seal to the metal electrodes by manipulating the formulation of the glass. While some advancements have been made, they have not proven beneficial for the current application. Thus, a strong need exists for a resistor glass seal material that will bond effectively to the metal electrodes in the spark plug.

SUMMARY OF THE INVENTION

In accordance with the present invention, the short comings and disadvantages of the prior art are overcome by utilizing a resistor seal composition comprising glass; at least one metal oxide; at least one filler material; and a branched or straight chained zirconium carboxylate.

Other features and advantages of the present invention will be appreciated and understood by those of ordinary skill in the art from the following drawings and detailed description.

BRIEF DESCRIPTION OF THE DRAWING

The following figures are meant to be exemplary, not limiting.

DETAILED DESCRIPTION OF THE INVENTION

Figure 1:
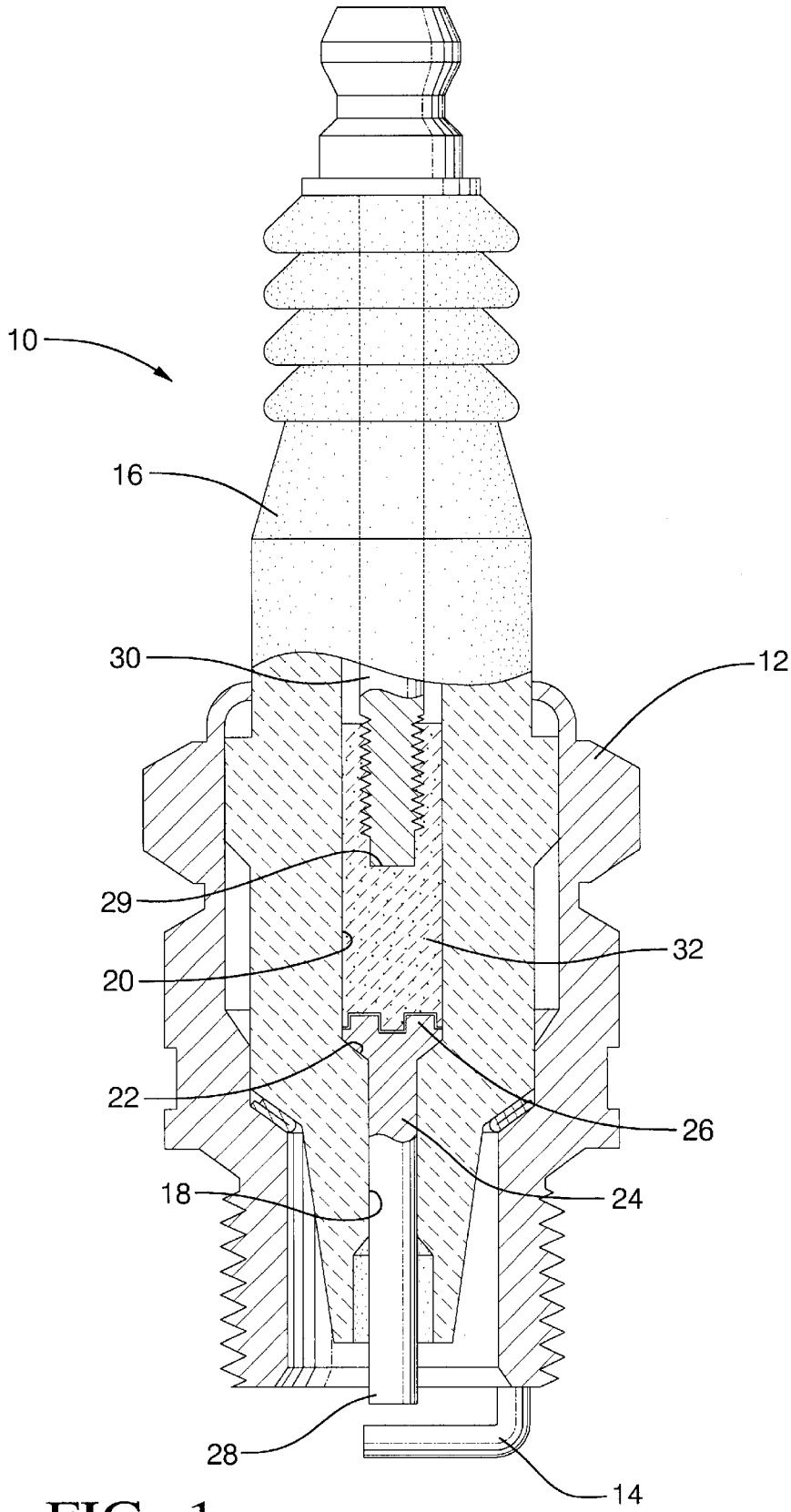
FIG. 1 is a cross sectional view of one embodiment of a spark plug comprising the resistor seal composition of the present invention.

Referring to FIG. 1, the spark plug 10 comprises a conventional outer metal shell 12, having a ground electrode 14 welded to the lower end thereof. Positioned within the metal shell 12 and secured in the conventional manner is the insulator 16. The insulator 16 is typically ceramic and may be comprised of a high alumina based material. The insulator 16 is formed with a center bore having a lower portion 18 of relatively small diameter and an upper portion 20 of large diameter which are connected by the insulator center bore ledge 22. Positioned in the lower portion 18 of the insulator center bore is the conventional center electrode 24. The center electrode 24 may be composed of any material that is compatible with the operating environment. Possible materials include metals such as nickel, copper, zinc, and others, as well as mixtures and alloys thereof. The center electrode 24 has an enlarged head 26 at the upper end thereof which rests on the inner insulator center bore ledge 22 and the lower end 28 thereof projecting beyond the lower tip of the insulator 16. Positioned in the upper portion 20 of the insulator center bore is a terminal screw 30, the resistor element or seal 32 is positioned in the insulator center bore 20 and is bonded to the center electrode head 26, to the terminal screw 30 and to the inner walls of the ceramic insulator.

The resistor seal compositions comprise composite mineral phases within a continuous glass phase, with a conductive material distributed throughout the network. In accordance with the composition, the glass phase comprises a strontium borate glass and/or a borosilicate glass. The strontium borate glass is a composition comprising from about 15 weight percent to about 35 weight percent strontium oxide (SrO), from about 50 weight percent to about 75 weight percent boron oxide ($B_2O_3$), and from about 3 weight percent to about 10 weight percent silicon dioxide ($SiO_2$). More preferably, the strontium borate glass comprises from about 20 weight percent to about 30 weight percent strontium oxide (SrO), from about 60 weight percent to about 70 weight percent boron oxide ($B_2O_3$), and from about 5 weight percent to about 8 weight percent silicon dioxide ($SiO_2$). Still more preferably, the strontium borate glass comprises about 25 weight percent strontium oxide (SrO), about 65 weight percent boron oxide ($B_2O_3$), and from about 7 weight percent silicon dioxide ($SiO_2$). However, such glasses containing different portions of strontium oxide and boron oxide are suitable. A suitable borosilicate glass composition comprises from about 50 weight percent to about 75 weight percent $SiO_2$, from about 12 weight percent to about 35 weight percent $B_2O_3$, and from about 2 weight percent to about 10 weight percent $Al_2O_3$. More preferably, the borosilicate glass composition comprises from about 60 weight percent to about 70 weight percent $SiO_2$, from about 20 weight percent to about 30 weight percent $B_2O_3$, and from about 3 weight percent to about 7 weight percent $Al_2O_3$. Still more preferably, the borosilicate glass composition comprises about 65 weight percent $SiO_2$, about 23 weight percent $B_2O_3$, and about 5 weight percent $Al_2O_3$. However, variations thereof are suitable.

The mineral phases provide high temperature stability to the spark plug, aid in compaction of the granulated materials, and provide a high surface area, which allows the conductive material to form a continuous path in the metal-glass matrix. Typically, the composite mineral phases include metal oxides and filler materials. The entire glass seal composition may comprise from about 10 weight percent to about 50 weight percent metal oxides and from about 15 weight percent to about 75 weight percent of filler material. More preferably, the glass seal composition comprises from about 17 weight percent to about 45 weight percent of metal oxides and from about 37 weight percent to about 58 weight percent of filler. A still more preferred composition comprises from about 20 weight percent to about 29 weight percent of metal oxides and from about 45 weight percent to about 53 weight percent of filler material.

Suitable metal oxides include aluminum oxide ($Al_2O_3$), zinc oxide ($ZnO_2$), zirconium oxide ($ZrO_2$) and the like, with $ZrO_2$ being preferred. Suitable filler materials include silicon dioxide ($SiO_2$), mullite [($3Al_2O_32SiO_2$) 72 wt. % $Al_2O_3$], and the like, with mullite being preferred.

The particles of the mineral phases may be on the order of about 3 microns to about 600 microns in size. Preferably, the size of the particles is about 10 microns to about 300 microns. Still more preferably, the size of the particles is about 30 microns to about 150 microns.

Figure 2:
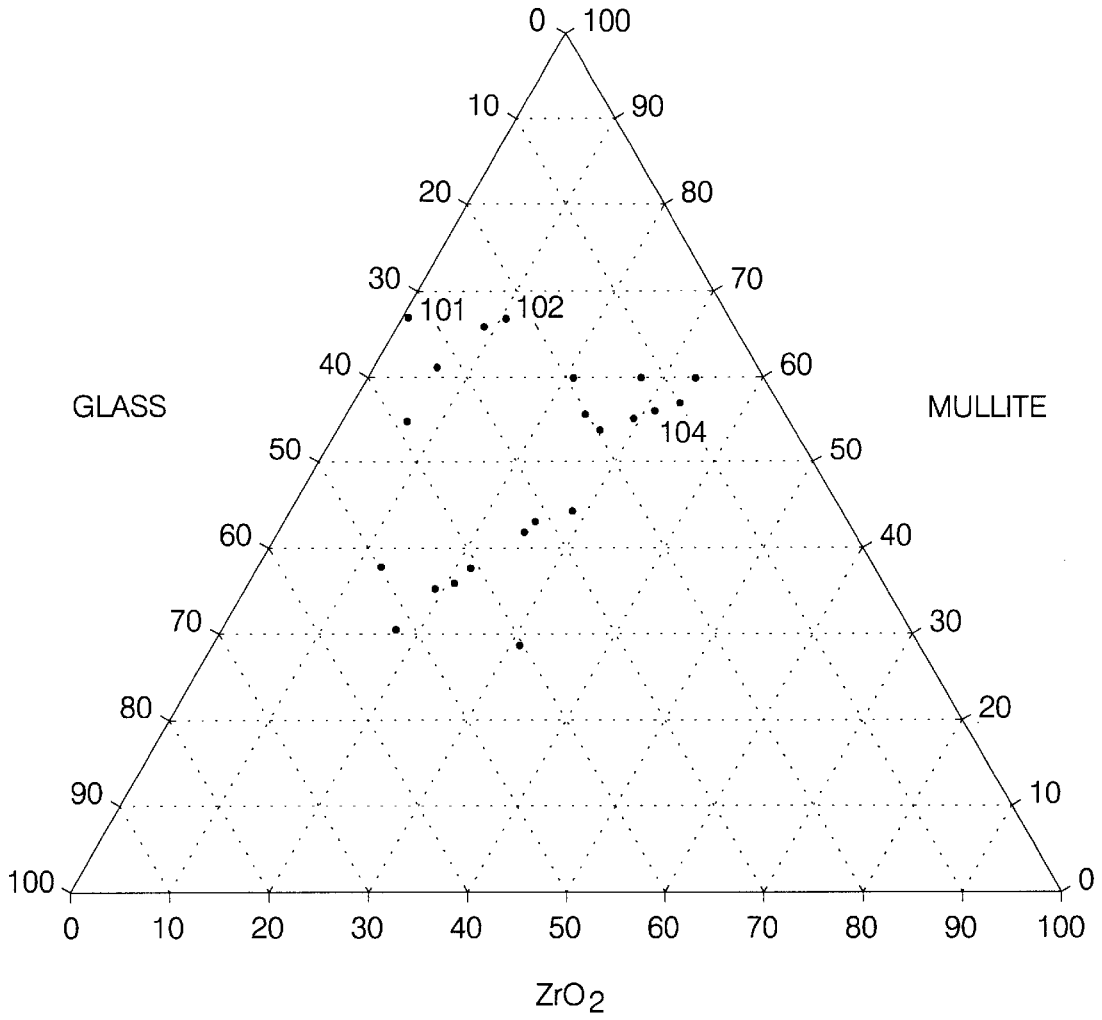
FIG. 2 is a ternary diagram comparing performance data from various glass seal compositions.

FIG. 2 is a ternary diagram comparing performance data from various glass seal compositions comprising glass, mullite, zirconia ($ZrO_2$), and zirconium citrate as a conductive material. The spark plugs were fired at 890° C. for 19 minutes. The quantity of conductive material was held constant while quantities of the other components were fluctuated in order to identify preferred compositions. For example, at a point 101 where the composition comprised below about 10 volume percent (vol %) zirconia, steeply increased aging and resistance were observed. At a point 102 where the composition comprised above about 62 vol % mullite, increased aging and poor particle packing were observed. At a point 103 where the composition comprised below about 50 vol % mullite, higher T-posts, poor granulation, and increased variability were observed.

The conductive material, which provides for a conductive mechanism within the spark plug resistor seal, can be any conductive material compatible with the high temperatures of the plug environment. Preferably, the conductive material is introduced into the mineral-glass matrix on a molecular level as a complex molecular species. Once in the mineral-glass matrix, the complex molecular species will react with the surfaces of the mineral phases and, upon heating, bond to the mineral phase surfaces, resulting in a uniform coating on the mineral phase throughout the mineral-glass matrix. Preferably, the conductive material comprises carbon and a metal. More preferably, the conductive material comprises carbon and zirconium. Still more preferably, the conductive material comprises one or more carboxylate and zirconium. An especially preferred conductive material is zirconium acetate. Still more preferred is zirconium acetate in the form of zirconium acetate ammonium complex.

The preferred conductive materials are yielded from the reaction of zirconium carbonate [$Zr(CO_3)_2$] with a carboxylic acid, resulting in a branched or straight chained zirconium carboxylate. Suitable carboxylic acids are listed in Table I.

TABLE I

| CARBOXYLIC ACIDS | |
|---|---|
| Formic | HCOOH |
| Acetic | $CH_3COOH$ |
| Propionic | $CH_3CH_2COOH$ |
| Butyric | $CH_3(CH_2)_2COOH$ |
| Stearic | $CH_3(CH_2)_{16}COOH$ |
| Citric | $C_6H_8O_7$ |

The preferred carbon source, zirconium acetate ammonium complex, can be derived from the following reaction:

$$Zr(CO_3)_2+CH_3COOH \rightarrow ZrNH_4(CH_3CO_2)$$

(Zirconium Carbonate) (Acetic Acid) (Zirconium Acetate Ammonium Complex)

It will be appreciated that alternative embodiments, such as zirconium isopropoxide, zirconium oxylate, zirconium citrate and other zirconium carboxylates will provide the same benefits as zirconium acetate. These compounds are yielded from the reaction of zirconium carbonate and the appropriate carboxylic acid.

Figure 3:
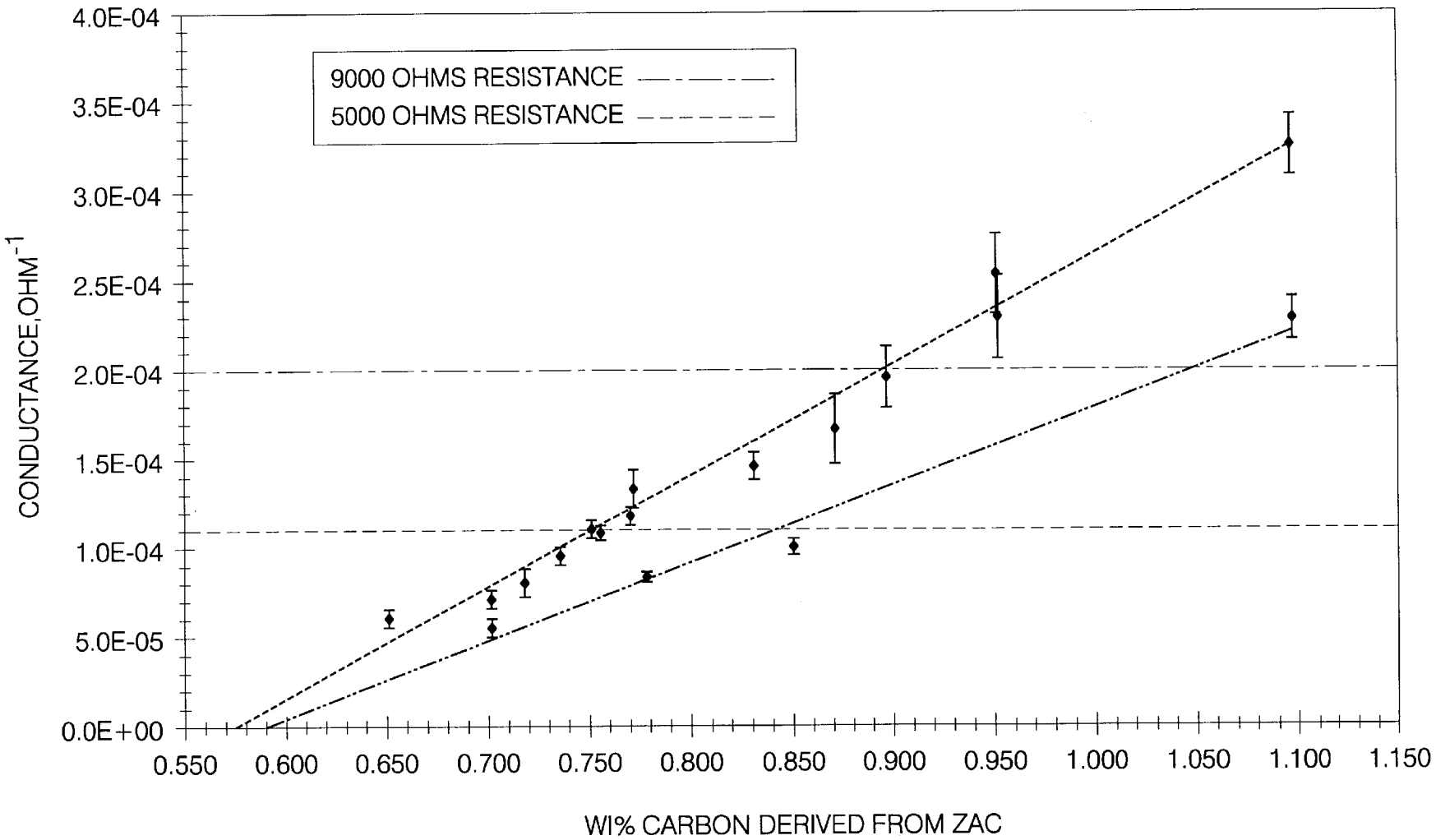
FIG. 3 is a graphical representation of sparkplug conductance as measured over changes in glass seal carbon content.

Particular resistance ranges can be targeted by modifying the concentration of the conductive material. FIG. 3 plots spark plug conductance ($ohm^{-1}$) and resistance (ohms) against the weight percent of carbon derived from zirconium citrate ammonium complex (ZAC). Each formulation comprises 15 vol % $ZrO_2$, 56 vol % mullite, 29 vol % glass, and various levels of carbon derived from zirconium citrate. FIG. 3 shows two versions of the fitted linear equation, i.e., a) (1630/ohms)+0.573=wt % carbon; and b) $ohm^{-1}$=6.14E−04(wt % carbon)−3.52E−04.

As an example, a resistor seal composition comprising 0.755 weight percent carbon results in a resistance value of about 9000 ohms. As another example, a resistor seal composition comprising 0.950 weight percent carbon results in a resistance value of about 5000 ohms. Generally, the composition is adapted to provide an electrical resistance range in-between about 2000 ohms and about 12,000 ohms.

Preferably, the glass seal powder preparation process generally follows that described in U.S. Pat. No. 5,304,894, which is incorporated herein by reference. The glass frit materials, the mullite, and the zirconium oxide are blended in a vessel at a controlled speed to insure proper mixing of the materials. Fluid is then introduced to the batch to form agglomerates in the premixed powders. The fluid phase comprises water and a zirconium carboxylate to form a solution of specific carbon content.

Most zirconium carboxylates may be commercially purchased either as a powder and added to water to form a solution, or may be purchased as a solution and adjusted with water to provide for an adequate carbon level. When preparing a solution of a zirconium carboxylate and water the total carbon content should be monitored so as to have consistent control of spark plug resistance. It is also important to add enough fluid to the batch so as to provide sufficient moisture and binder to convert the fine, dusty, poor flowing starting powders to free flowing, dust free, courser granules. In an advantage over the prior art, the zirconium carboxylate acts as a binder during the processing of the raw materials, keeping different types of particles in intimate contact. Adequate binding is necessary to form free flowing agglomerates.

Agitation of the pre-mixed powders and the addition of fluid results in the formation of agglomerates or granules. The soluble carbon complex is sprayed into the mixture. In an advantage over the prior art, the zirconium carboxylate reacts with the surfaces of the glass and metal oxide particles, coating them uniformly, which results in a homogeneous distribution of the carbon phase throughout the batch. Homogeneous distribution of the carbon phase is preferred for uniformity of the final material and consistent properties in the final product.

Average agglomerate size and agglomerate size distribution can be controlled by regulating mixing time, mixing rate, and moisture content. The preferred agglomerate size is finer than about 28 mesh (−28M) and coarser than about 150 mesh (+150M). Agglomerate size and agglomerate size distribution within the preferred ranges allow for a free flowing product with an optimized powder bulk density. Following agglomerate formation, the resulting material is placed in a dryer at about 80° C. until fully dried. The powder is then removed and screened.

Next, the powder composition is assembled into a spark plug. Referring to FIG. 1, spark plug assembly begins with placing the center electrode 24 into the insulator cavity. The resistor glass material granules are loaded and tamped to form the resistor glass seal 32. The terminal screw 30 is then placed on top of the glass resistor seal 32 and pressed in at room temperature. Next, the parts are heated to a temperature sufficient for the glass to become molten, typically up to about 850° C. +/−50° C. The terminal screw 30 is then pressed down into the insulator cavity and the resistor seal is cooled quickly, consequently setting in the terminal screw 30.

In contrast to the prior art, which teaches the combination of multiple carbon sources to form an appropriate conductive material, the present invention provides a single carbon source within the resistor seal to form the conductive material. The advantages of the single carbon source of the present invention include easier and more efficient resistance adjustments, a dramatic slowing or elimination of electrical aging within the spark plug, an improved ability to meet tighter spark plug specifications, and a reduction in part-to-part variability. A detailed discussion of these and other advantages, along with examples, is provided below.

Tables II–VI show prepared resistor glass seal formulations prepared in accordance with the method described above. Each composition comprises a zirconium carboxylate as the sole carbon source.

TABLE II

| | |
|---|---|
| Zirconium citrate powder | 4.86 wt. % |
| Zirconium Oxide | 44.60 |
| Mullite | 22.32 |
| Borosilicate glass frit | 19.52 |
| Strontium borosilicate glass frit | 8.70 |

Table III lists standard aging data for sparks plugs comprising the resistor seal composition of Table II.

TABLE III

Standard Aging Data
6.4 kV Spark Gap, One Minute Cycles
POWDER P283

| Temp C. | Batch-plug | Initial | 1 minute | % change | Avg. % | 2 minutes | % change | Avg. % | 3 minutes | % change | Avg. % |
|---|---|---|---|---|---|---|---|---|---|---|---|
| 845 | 597 | 14.936 | 14.778 | −1.06% | −0.91% | 14.725 | −1.41% | −1.20% | 14.694 | −1.62% | −1.50% |
| | 597 | 15.819 | 15.737 | −0.52% | | 15.697 | −0.77% | | 15.643 | −1.11% | |
| | 597 | 15.412 | 15.232 | −1.17% | | 15.196 | −1.40% | | 15.138 | −1.78% | |
| 880 | 592 | 10.641 | 10.49 | −1.42% | −1.12% | 10.455 | −1.75% | −1.39% | 10.437 | −1.92% | −1.59% |
| | 592 | 12.691 | 12.754 | −1.06% | | 12.724 | −1.30% | | 12.696 | −1.52% | |
| | 592 | 12.666 | 12.575 | −0.87% | | 12.544 | −1.12% | | 12.515 | −1.35% | |
| 875 | 593 | 8.604 | 8.534 | −0.81% | −0.76% | 8.513 | −1.06% | −1.01% | 8.497 | −1.24% | −1.17% |
| | 593 | 10.122 | 10.016 | −1.05% | | 9.99 | −1.30% | | 9.970 | −1.50% | |
| | 593 | 9.06 | 9.022 | −0.42% | | 9 | −0.66% | | 8.990 | −0.77% | |
| 890 | 594 | 7.605 | 7.565 | −0.53% | −0.42% | 7.549 | −0.74% | −0.66% | 7.536 | −0.91% | −0.83% |
| | 594 | 6.332 | 6.312 | −0.32% | | 6.3 | −0.51% | | 6.288 | −0.70% | |
| | 594 | 8.035 | 8.002 | −0.41% | | 7.976 | −0.73% | | 7.965 | −0.87% | |
| 905 | 595 | 7.001 | 6.996 | −0.07% | −0.32% | 8.985 | −0.23% | −0.44% | 6.975 | −0.37% | −0.60% |
| | 595 | 7.039 | 7.015 | −0.34% | | 7.009 | −0.43% | | 6.993 | −0.65% | |
| | 595 | 6.114 | 6.08 | −0.56% | | 6.073 | −0.67% | | 6.065 | −0.80% | |
| 920 | 596 | 5.834 | 5.822 | −0.21% | 0.04% | 5.814 | −0.34% | −0.08% | 5.808 | −0.44% | −0.12% |
| | 596 | 5.719 | 5.728 | 0.17% | | 5.726 | 0.12% | | 5.726 | 0.13% | |
| | 595 | 5.962 | 5.971 | 0.15% | | 5.96 | −0.03% | | 5.959 | −0.05% | |
| 950 | 598 | 5.243 | 5.312 | 1.32% | 3.92% | 5.316 | 1.39% | 7.20% | 5.329 | 1.65% | 15.68% |
| | 598 | 5.616 | 5.808 | 3.42% | | 5.876 | 4.63% | | 5.973 | 6.35% | |
| | 598 | 5.316 | 5.892 | 7.03% | | 6.147 | 15.59% | | 7.390 | 38.97% | |

TABLE IV

| | |
|---|---|
| Zirconium Citrate, Ammonium Complex Solution | 6.35 wt. % (acqueous solution is 14.7 wt. % Carbon) |
| Zirconium Oxide | 22.19 |
| Mullite | 49.27 |
| Strontium borosilicate glass frit | 24.80 |

TABLE V

| | |
|---|---|
| Zirconium Citrate, Ammonium Complex Solution | 6.35 wt.% (acqueous solution is 14.7 wt. % Carbon) |
| Zirconium Oxide | 22.19 |
| Mullite | 46.66 |
| Strontium borosilicate glass frit | 24.80 |

TABLE VI

| Material | Parts (by wt.) |
|---|---|
| Zirconium acetate solution (30 wt. % acetate, 70 wt. % water) | 12.0 |
| Zirconium Oxide | 43.8 |
| Mullite | 22.9 |
| Bentonite | 1.8 |
| Silicon | 1.1 |

TABLE VI-continued

| Material | Parts (by wt.) |
|---|---|
| Antimony | 1.1 |
| Borosilicate glass frit | 20.0 |
| Strontium borosilicate glass frit | 8.9 |

Figure 4:
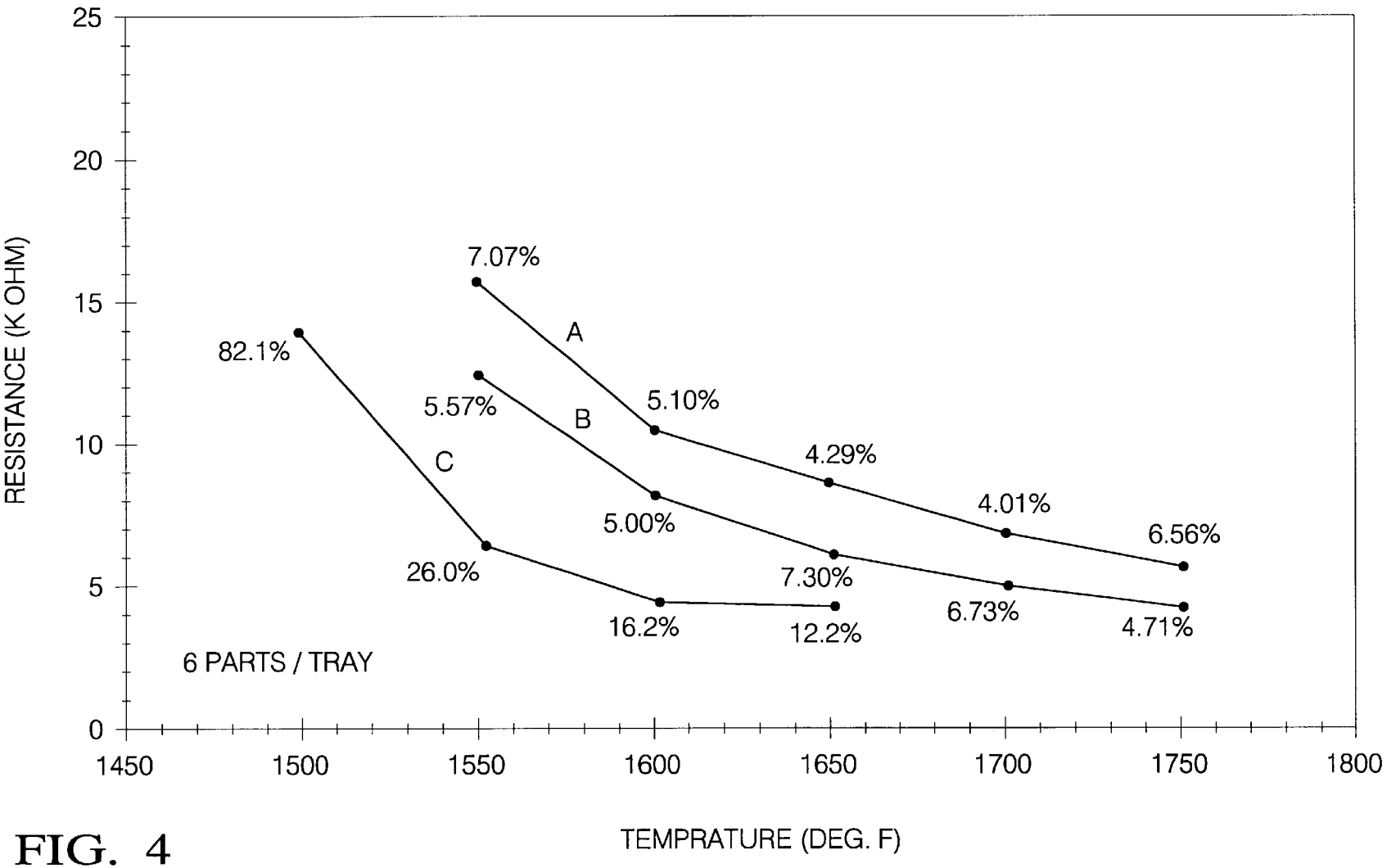
FIG. 4 is a graphical representation of spark plug resistance as measured over changes in temperature.

FIG. 4 plots spark plug resistance (K ohm) against firing temperature. Three batches of spark plugs were fired in a furnace for 15 to 18 minutes at various temperatures, as shown, and measured for resistance. Line A plots resistance observed with a spark plug comprising a carbon source derived from an aqueous zirconium citrate solution. Line B plots resistance observed with a spark plug comprising a carbon source derived from dry zirconium citrate blend. Line C plots resistance observed with a spark plug comprising a resistor seal made in accordance with the prior art. Lines A and B show markedly less variation in resistance over changes in firing temperature.

Use of the zirconium carboxylate containing compositions allows for the elimination of several materials necessary with the resistor seal composites of the prior art. Table VII lists typical composite materials and their respective presence in the prior art and one embodiment of the present invention. It will be noted that at least six materials are replaced by the zirconium carboxylate compounds of the present invention. As discussed above, the zirconium carboxylate compound replaces the dual carbon source consisting of 10-X sucrose and thermax. Other beneficial properties of the zirconium carboxylate compound allow for replacement of bentonite, lithium carbonate, silicon, and antimony, which serve as a binder, a flux, an oxygen getter, and to wet the electrodes, respectively. Fewer components allows for superior consistency in the resistance levels of the final products as well as lower manufacturing costs.

TABLE VII

| COMPONENTS OF TYPICAL PRIOR ART COMPOSITION | COMPONENTS IN ACCORDANCE WITH THE PRESENT INVENTION |
|---|---|
| Glass frit | Glass frit |
| Zirconia | Zirconia |
| Mullite | Mullite |
| Bentonite | Zirconium carboxylate |
| Antimony | |
| Lithium carbonate | |
| 10-X sugar | |
| Thermax (particulate carbon) | |
| Silicon | |

Figure 5:
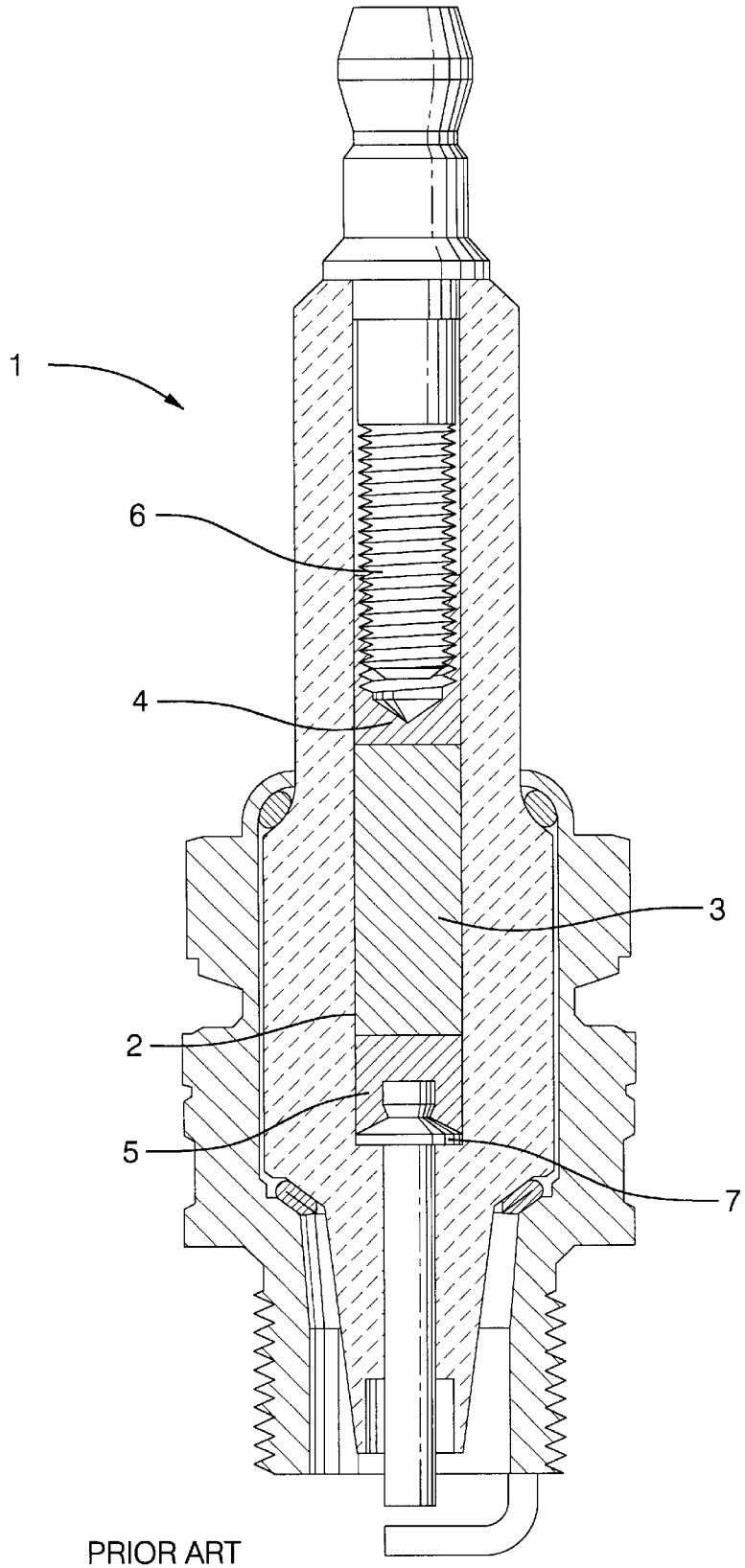
PRIOR ART FIG. 5
FIG. 5 is a cross sectional view of a spark plug of the prior art.

In another advantage over the prior art, the resistor glass seal composition reduces or eliminates the need for conductor glass seals. Referring to FIG. 5, a typical spark plug 1 of the prior art requires a three part glass seal 2 wherein the resistor glass seal 3 is positioned in the center with conductive glass seals above 4 and below 5. The conductive glass seals interface with the terminal post electrode 6 and the center wire electrode 7. Such three part seals are a disadvantage, in that they are placed into the plug at the expense of the resistor, shortening the ends of the resistor seal. The reduction in length of the resistor seal decreases its ability to suppress radio frequency interference (RFI), its primary function. In contrast, the resistor glass seal compositions of the present invention render the resistor seal bondable directly to the electrodes, resulting in improved spark plug performance. Moreover, superior contact between the resistor seal and the electrodes due to reductions in electrode corrosion and/or oxidation when fired in air at high temperatures has been observed.

While preferred embodiments have been shown and described, various modifications and substitutions mat be made thereto without departing from the spirit and scope of the invention. Accordingly, it is to be understood that the present invention has been described by way of illustration and not limitation.

What is claimed is:

1. A resistor seal composition comprising:

a) glass;

b) at least one metal oxide;

c) at least one filler material; and d) a branched or straight chained zirconium carboxylate.

2. A resistor seal composition in accordance with claim 1, wherein said zirconium carboxylate is zirconium acetate.

3. A resistor seal composition in accordance with claim 2, further comprising zirconium citrate.

4. A resistor seal composition in accordance with claim 2, wherein said zirconium acetate is present as zirconium acetate ammonium complex.

5. A resistor seal composition in accordance with claim 1, wherein said metal oxide is present within the range of about 10 weight percent to about 50 weight percent.

6. A resistor seal composition in accordance with claim 1, wherein said metal oxide is selected from the group comprising aluminum oxide, zinc oxide, zirconia and mixtures thereof.

7. A resistor seal composition in accordance with claim 1, comprising about 15 weight percent to about 75 weight percent filler material.

8. A resistor seal composition in accordance with claim 1, wherein said filler material is selected from the group comprising silicone oxide, mullite and mixtures thereof.

9. A resistor seal composition according to claim 1, wherein said glass is selected from the group comprising borosilicate glass, strontium borate glass and mixtures thereof.

10. A resistor seal composition according to claim 1, wherein said zirconium carboxylate is bonded to the surface of said metal oxide.

11. A resistor seal composition according to claim 1, wherein the composition is adapted to provide an electrical resistance range from about 2000 ohms to about 12,000 ohms.

12. A resistor spark plug comprising:

a) an outer shell; comprising an insulator disposed therein;

b) an insulator concentrically disposed within said outer shell, said insulator comprising a centerbore having a lower portion and an upper portion;

c) an electrode disposed in said lower portion of said centerbore;

d) a terminal screw disposed in said upper portion of said centerbore;

e) a resistor seal disposed in said centerbore between and in electric communication with said electrode and said terminal screw, said resistor seal comprising glass, at least one metal oxide, at least one filler material, and a branched or straight chained zirconium carboxylate.

* * * * *